US006045142A

United States Patent [19]

Andrich

[11] Patent Number: 6,045,142

[45] Date of Patent: Apr. 4, 2000

[54] SKATE

[76] Inventor: Michael S. Andrich, 4505 Sanford, Houston, Tex. 77035

[21] Appl. No.: 09/014,363

[22] Filed: Jan. 27, 1998

[51] Int. Cl.[7] ..... A63C 17/02

[52] U.S. Cl. ..... 280/11.22; 280/811; 280/11.25

[58] Field of Search ..... 280/11.19, 11.2, 280/11.22, 11.23, 11.25, 11.27, 11.28, 811, 842

[56] References Cited

U.S. PATENT DOCUMENTS 5,931,480 8/1999 Schroeder ..... 280/11.2

*Primary Examiner*—Lanna Mai
*Assistant Examiner*—Jeff Restifo
*Attorney, Agent, or Firm*—John R Casperson

[57] ABSTRACT

A in-line skate is converted to all terrain use by attaching mounting brackets which carry large wheels and a suspension system.

20 Claims, 4 Drawing Sheets

SKATE

BACKGROUND OF THE INVENTION

In one aspect, this invention relates to a mounting bracket for a wheel. In another aspect, this invention relates to an in-line skate. In another aspect, this invention relates to a method for modifying an in-line skate to enable use off hard surfaces and on hard surfaces with the use of suspension.

In line skates are well known. Typically, the skates have four in-line wheels. However, the wheels of such skates are generally small and are not highly effective except on hard surfaces, such as asphalt or concrete. The skates typically also lack suspension systems. The small wheels and lack of suspension render the skates generally unsuitable for "off-road" use.

Off-road skates having large wheels and suspension systems have been proposed. However, these skates are expensive and bulky, and generally not highly suitable for use on hard surfaces.

An attachment to enable an in-line skate to be converted from hard-surfaces with regular size wheels to soft-surface use would be very desirable. An inexpensive in-line skate which is suitable for use on soft surfaces would also be very desirable.

OBJECTS OF THE INVENTION

It is an object of this invention to provide an in-line skate which is suitable for off-road use.

It is a further object of this invention to provide an attachment to enable an in-line skate which is set up for use on hard surfaces to be converted to off-road use.

It is another object of this invention to provide a method for converting an in-line skate from hard-surface to soft-surface use.

SUMMARY OF THE INVENTION

In accordance with one embodiment of the invention, there is provided a method for modifying a hard surface in-line skate for use on soft surfaces. In line skates suitably employed in the method comprise a frame defining transverse boreholes for carrying a first wheel, a second wheel, a third wheel, and a fourth wheel in longitudinal alignment from a back end to a front end of the frame. The wheels have a first diameter. In accordance with the invention, the wheels are removed. A front wheel bracket is attached to the frame at the borehole for carrying the third wheel. The front wheel bracket carries a wheel suitable for use on soft surfaces and which has a diameter which is greater than the first diameter. A rear wheel bracket is attached to the frame at the borehole for carrying the second wheel. The rear wheel bracket carries a wheel suitable for use on soft surfaces and which has a diameter which is greater than the first diameter.

In accordance with one embodiment of the invention, there is provided a mounting bracket suitable for use in the just described method. The mounting bracket comprises a first side plate, a second side plate positioned parallel to the first side plate, and a spacer positioned between the first side plate and the second side plate. The first side plate is elongated and has a first end and a second end. The first side plate defines a hole adjacent to the first end for carrying a pivot pin and a hole adjacent to the second end for carrying an axle pin. The first side plate also defines an arcuate slot positioned between the first end and the second end for accepting a limit pin. The arcuate slot is radiused around the hole for carrying the pivot pin. The second side plate is elongated and has a first end and a second end. The second side plate defining a hole adjacent to the first end for carrying a pivot pin and a hole adjacent to the second end for carrying an axle pin. The second side plate also defines an arcuate slot positioned between the first end and the second end for accepting a limit pin. The arcuate slot is radiused around the hole for carrying the pivot pin. The spacer fixedly connects the first side plate and the second side plate in juxtaposition so that the hole for carrying the pivot pin, the hole for carrying the axle pin, and the arcuate slot of the elongated second plate are in alignment with the hole for carrying the pivot pin, the hole for carrying the axle pin, and the arcuate slot of the elongated first plate.

In another embodiment of the invention, there is provided an in-line skate which can be formed according to the above-described method and utilizing the above-described mounting brackets. The skate is formed from a boot a frame, first and second mounting brackets, first and second pivot pins, first and second axle pins, and first and second wheels. The boot is formed from an upper body and a sole. The sole has a heel and a toe. The frame is attached to the sole of the boot and extends away from the upper body. The frame has a back end positioned beneath the heel and a front end positioned beneath the toe and defines a first transverse borehole positioned beneath the heel, a second transverse borehole beneath the toe, a third transverse borehole between the first transverse borehole and the second transverse borehole, and a fourth transverse borehole between the third transverse borehole and the second transverse borehole. The first mounting bracket and the second mounting bracket are attached to the frame. Each mounting bracket comprises a first side plate and a second side plate. The second side plate is positioned parallel to the first side plate. The first side plate is elongated and has a first end and a second end and defines a hole adjacent to the first end for carrying a pivot pin and a hole adjacent to the second end for carrying an axle pin. The second side plate is elongated and has a first end and a second end and defines a hole adjacent to the first end for carrying a pivot pin and a hole adjacent to the second end for carrying an axle pin. The first pivot pin extends through the third borehole in the frame, the hole adjacent to the first end of the first side plate of the first mounting bracket, and the hole adjacent to the first end of the second side plate of the first mounting bracket. The first pivot pin pivotally connects the first mounting bracket to the frame beneath the heel of the sole. The first side plate and the second side plate of the first mounting bracket are mounted to the frame in juxtaposition with each other so that the hole for carrying the pivot pin and the hole for carrying the axle pin of the first side plate are in alignment with the hole for carrying the pivot pin and the hole for carrying the axle pin of the second side plate. The second pivot pin extends through the fourth borehole in the frame, the hole adjacent to the first end of the first side plate of the second mounting bracket, and the hole adjacent to the first end of the second side plate of the second mounting bracket. The second pivot pin pivotally connects the second mounting bracket to the frame beneath the toe of the sole. The first axle pin is carried by the holes adjacent to the second end of the first side plate and the second end of the second plate of the first mounting bracket. The first wheel is rotatably mounted to the first axle pin. The second axle pin is carried by the holes adjacent to the second end of the first side plate and the second end of the second plate of the second mounting bracket. The second wheel is rotatably mounted to the second axle pin.

DETAILED DESCRIPTION OF THE INVENTION

Figure 1:
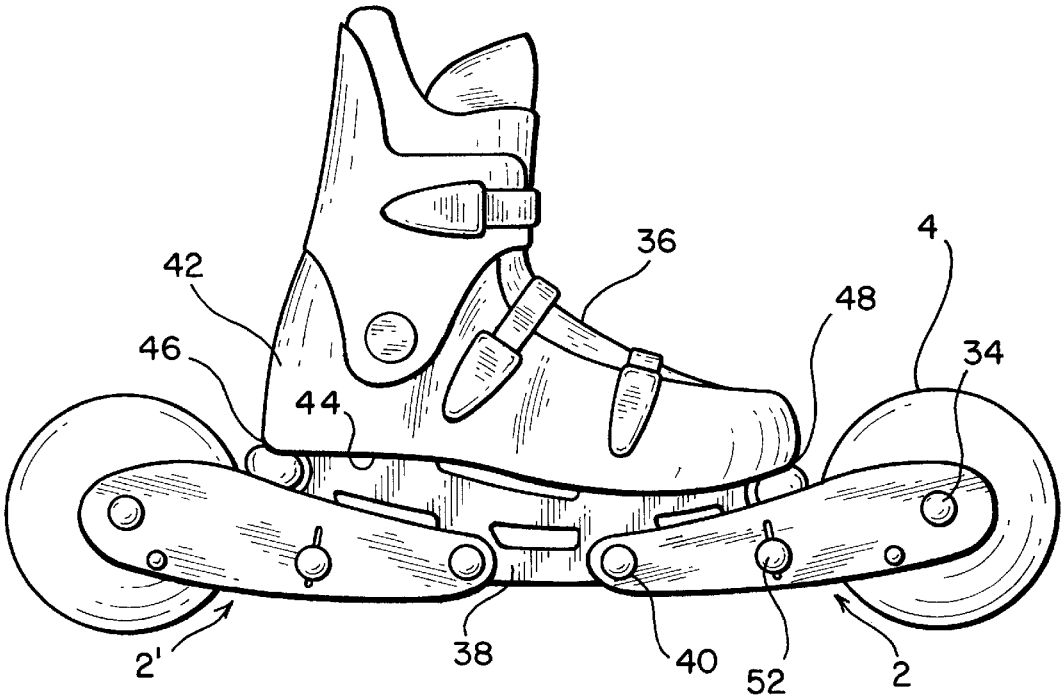
FIG. 1 is a pictorial representation of one embodiment of the invention.

In accordance with one embodiment of the invention, and with references to FIGS. 3–6, there is provided a mounting bracket 2 for a wheel 4. The mounting bracket comprises a first side plate 6, a second side plate 8 positioned parallel to the first side plate, and a spacer 10 positioned between the first side plate and the second side plate.

The first side plate is elongated and has a first end and a second end. The first side plate defines a hole 12 adjacent to the first end for carrying a pivot pin and a hole 14 adjacent to the second end for carrying an axle pin. The first side plate also defines an arcuate slot 16 positioned between the first end and the second end for accepting a limit pin. The arcuate slot is radiused around the hole 12 for carrying the pivot pin.

The second side plate 8 is elongated and has a first end and a second end. The second side plate defines a hole 18 adjacent to the first end for carrying a pivot pin and a hole 20 adjacent to the second end for carrying an axle pin. The second side plate also defines an arcuate slot 22 positioned between the first end and the second end for accepting a limit pin. The arcuate slot is radiused around the hole 18 for carrying the pivot pin.

The spacer 10 fixedly connects the first side plate and the second side plate in juxtaposition so that the hole for carrying the pivot pin, the hole for carrying the axle pin, and the arcuate slot of the elongated second plate 8 are in alignment with the hole for carrying the pivot pin, the hole for carrying the axle pin, and the arcuate slot of the elongated first plate 6.

Preferably, the first side plate has a longitudinal axis, and the hole for carrying the pivot pin and the hole for carrying the axle pin are positioned along the longitudinal axis. The second end of the first side plate is preferably radiused around the hole for carrying the axle pin. The second side plate has a longitudinal axis and the hole for carrying the pivot pin and the hole for carrying the axle pin are positioned along the longitudinal axis. The second end of the second side plate is also preferably radiused around the hole for carrying the axle pin. The first side plate and the second side plate can be identical, however, it is preferred that they be mirror images of each other.

In a further preferred embodiment, the first side plate and the second side plate each further define a second hole 24, 24' adjacent to the second end for carrying an axle pin. The second hole for carrying an axle pin of the first side plate is positioned in alignment with the second hole for carrying an axle pin of the second side plate. Each second hole is positioned alongside the hole 14, 20 positioned along the longitudinal axis adjacent to the second end of each of the first side plate and the second side plate and is spaced apart from the longitudinal axis of the first side plate and the second side plate. The second hole permits the operable mounting of standard size wheels if desired.

Generally speaking, each of the first side plate and the second side plate has a first face and a second face. The spacer connects the second face of the first side plate to the second face of the second side plate. The holes for carrying the pivot pin, the holes for carrying the axle pin, and the arcuate slots for accepting the limit pin, are preferably countersunk from the first face, so that any required fasteners for the pins can be safely positioned in the assembled equipment. Generally speaking, each of the first side plate and the second side plate has a longitudinal axis. The spacer fixedly connecting the first side plate and the second side plate is positioned between the arcuate slot and the hole for carrying the axle pin. See FIG. 4.

The mounting bracket preferably further comprises a biasing means 26 mounted to the side plates and extending transversely from between the first side plate and the second side plate. Any suitable biasing means, such as coil or leaf springs can be used. However, a biasing means which is formed from a block, such as a cylindrical block, of an elastomeric polymer is preferred. A two-part polyurethane polymer has been tested with good results.

Figure 4:
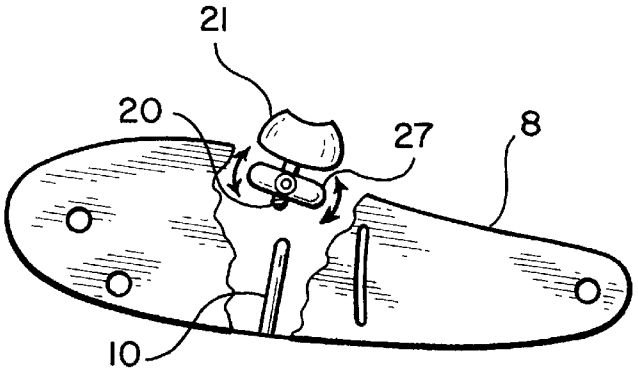
FIG. 4 is a partial breakaway side view of a portion of the invention shown in FIG. 1.

In one embodiment of the invention, and with reference to FIG. 4, the biasing means 26 comprises a connector plate element 27 having a threaded bore therethrough. The biasing means comprises a screw 20 extending from the block 21 of elastomeric polymer and received by the threaded bore through the connector plate element. If desired, the threaded bore through the connector plate element can be defined by a tubular insert which is press fitted into a borehole extending through the connector plate element. T-nuts will provide good results. The connector plate element can define a plurality of boreholes to permit the biasing means to be mounted in any one of a plurality of positions. However, it is preferred that the connector plate element 27 be pivotally connected to the first side plate and the second side plate such as by screws 29, 29' shown in FIG. 3. This feature permits the device to be used in a wide variety of designs and/or boot sizes. The connector plate element will generally be positioned in a plane on or parallel to a radius drawn from pivot pin.

Although the invention could be marketed without wheels, or separately from wheels, it is assembled with wheels in one embodiment. For this, an axle pin 34 is carried by the holes adjacent to the second end of the first side plate and the second side plate, and a wheel 4 is rotatably mounted to the axle pin. See FIG. 3. For all terrain use, a large wheel is preferably attached, with the periphery of the wheel extending beyond the periphery of the bracket. Generally speaking, all terrain wheels will have a diameter in the range of from about 3 inches to about 6 inches, and a width in the range of from about 1 to about 2 inches.

Figure 2:
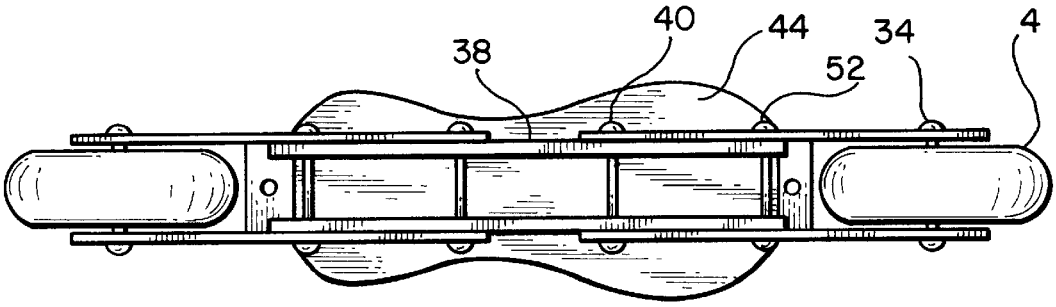
FIG. 2 is a bottom view of the invention as shown in FIG. 1.
Figure 5:
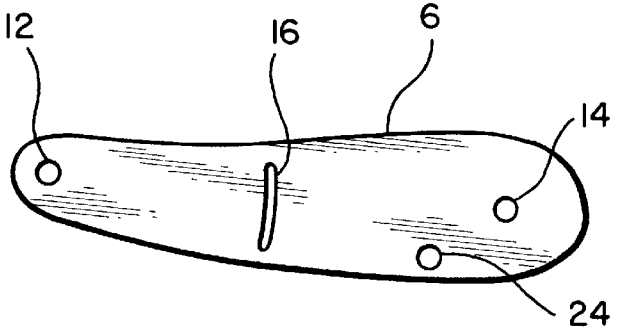
FIG. 5 is a side view of a portion of the invention shown in FIG. 4.
Figure 6:
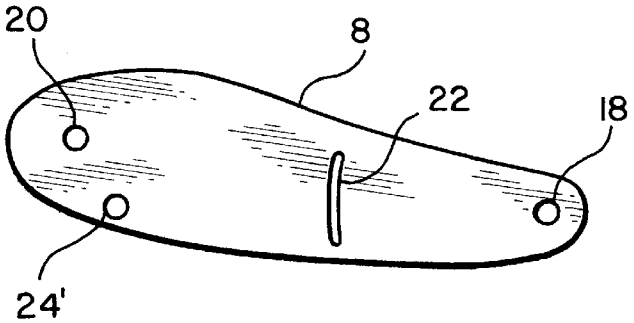
FIG. 6 is a side view of another portion of the invention shown in FIG. 4.
Figure 3:
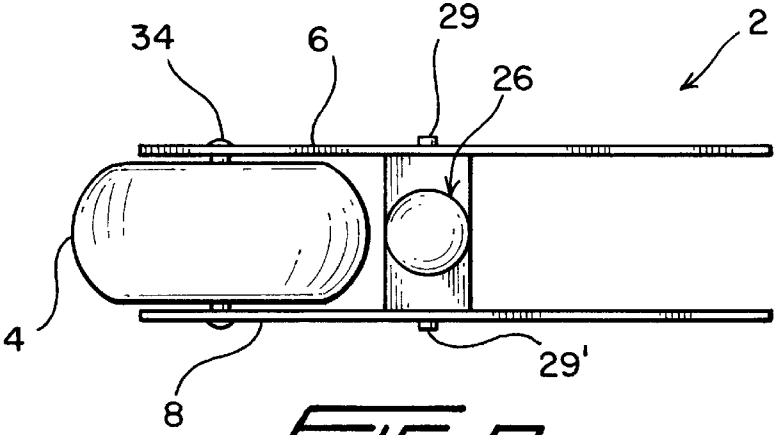
FIG. 3 is a top view of a portion of the invention shown in FIG. 1.
Figure 9:
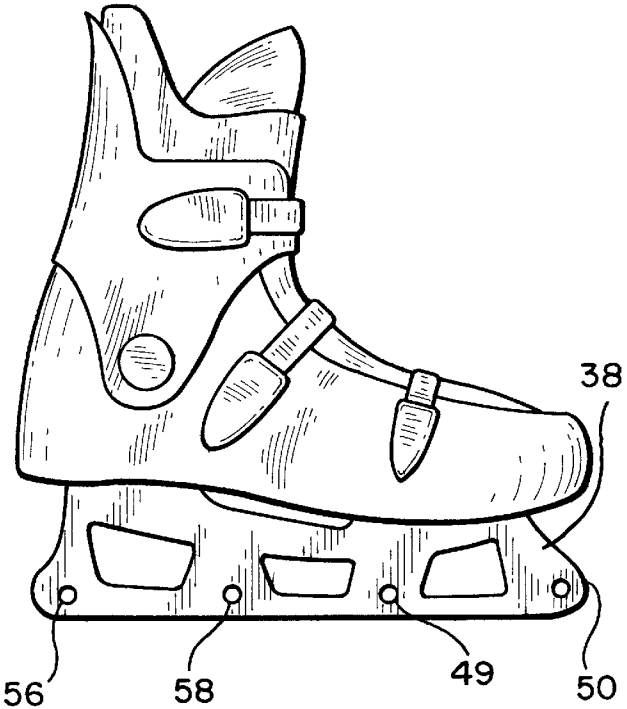
FIG. 9 (PRIOR ART)
FIG. 9 illustrates a prior art boot to which the invention can be applied.

For use, and with reference to FIG. 1, the invention can be employed in combination with a boot 36, a frame 38, and a pivot pin 40. The boot is formed from an upper body 42 and a sole 44. The sole has a heel 46 and a toe 48. The frame 38 is attached to the sole of the boot and extends away from the upper body. With reference to FIG. 9, the frame 38 has a borehole 48 extending transversely therethrough and a front end positioned beneath the toe of the sole. With reference to FIGS. 1 and 2, the pivot pin 40 extends through the borehole in the frame and through the hole adjacent to the first end of the first side plate and the hole adjacent to the first end of the second side plate. The pivot pin 40 pivotally connects the mounting bracket 2 to the frame. The biasing means is positioned between the spacer and the toe of the sole to bias the mounting bracket away from the toe of the sole. An axle pin 34 is carried by the holes adjacent to the second end of the first side plate and the second side plate. A wheel 4 is rotatably mounted to the axle pin. Preferably, the frame further has a borehole 50 extending transversely therethrough. See FIG. 9. With reference to FIG. 1, a limit pin 52 extends through the borehole 50 in the frame, the slot through the first side plate, and the slot through the second side plate.

Each slot has an upper end and a lower end. The bracket is pivotable from a first position wherein the limit pin is positioned adjacent to the upper end of each slot to a second position in which the limit pin is positioned adjacent to a lower end of each slot. The mounting bracket is biased toward the first position by the biasing means.

Preferably, and in similar manner, a mounting bracket 2' is attached to the back end of the skate. The biasing means is positioned between the spacer and the heel of the sole to bias the mounting bracket away from the heel of the sole.

Figure 7:
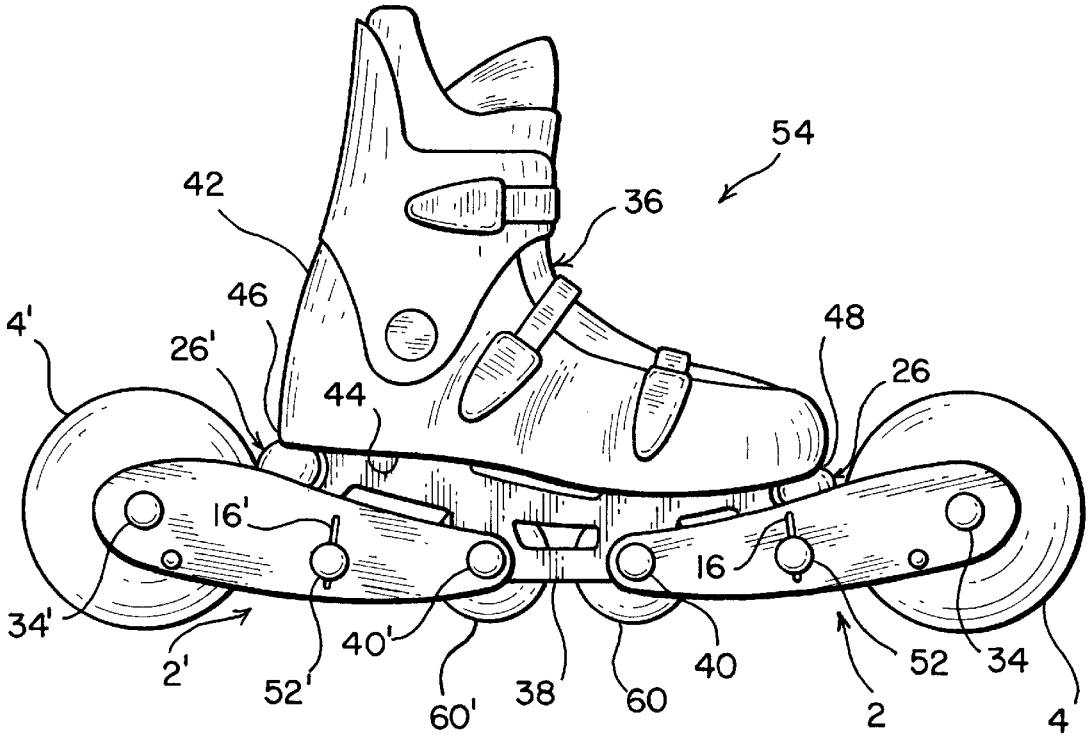
FIG. 7 is a pictorial representation of another embodiment of the invention.

In another embodiment of the invention, and with reference to FIG. 7, an in-line skate 54 according to the invention is formed from a boot 36, a frame 38, first and second mounting brackets 2,2', first and second pivot pins 40, 40', first and second axle pins 34,34', and first and second wheels 4,4'.

The boot is formed from an upper body 42 and a sole 44. The sole has a heel 46 and a toe 48.

The frame 38 is attached to the sole of the boot and extends away from the upper body. The frame has a back end positioned beneath the heel and a front end positioned beneath the toe and defines, with reference to FIG. 9, a transverse borehole 56 positioned beneath the heel, a transverse borehole 50 beneath the toe, a transverse borehole 49 between the transverse borehole 56 and the transverse borehole 50, and a transverse borehole 58 between the transverse borehole 48 and the transverse borehole 50. Many commercially marketed in line skates having four in line-wheels meet these requirements.

The first mounting bracket and the second mounting bracket are attached to the frame. Each mounting bracket comprises a first side plate and a second side plate, which can be as previously described. The second side plate is positioned parallel to the first side plate. The first side plate is elongated and has a first end and a second end and defines a hole adjacent to the first end for carrying a pivot pin and a hole adjacent to the second end for carrying an axle pin. The second side plate is elongated and has a first end and a second end and defines a hole adjacent to the first end for carrying a pivot pin and a hole adjacent to the second end for carrying an axle pin.

The first pivot pin 40 extends through the borehole 49 in the frame, the hole adjacent to the first end of the first side plate of the first mounting bracket, and the hole adjacent to the first end of the second side plate of the first mounting bracket. The first pivot pin pivotally connects the first mounting bracket to the frame beneath the toe of the sole. The first side plate and the second side plate of the first mounting bracket are mounted to the frame in juxtaposition with each other so that the hole for carrying the pivot pin and the hole for carrying the axle pin of the first side plate are in alignment with the hole for carrying the pivot pin and the hole for carrying the axle pin of the second side plate.

The second pivot pin 40' extends through the borehole 58 in the frame, the hole adjacent to the first end of the first side plate of the second mounting bracket, and the hole adjacent to the first end of the second side plate of the second mounting bracket. The second pivot pin pivotally connects the second mounting bracket to the frame beneath the heel of the sole.

The first axle pin 34 is carried by the holes adjacent to the second end of the first side plate and the second end of the second plate of the first mounting bracket 2. The first wheel 4 is rotatably mounted to the first axle pin.

The second axle pin 34' is carried by the holes adjacent to the second end of the first side plate and the second end of the second plate of the second mounting bracket 2'. The second wheel 4' is rotatably mounted to the second axle pin.

Preferably, each side plate of the first mounting bracket defines an arcuate slot 16 positioned between the first end and the second end for accepting a limit pin 52. The arcuate slot is radiused around the hole for carrying the pivot pin. Each side plate of the second mounting bracket defines an arcuate slot 16' positioned between the first end and the second end for accepting a limit pin. The arcuate slot is radiused around the hole for carrying the pivot pin.

The first limit pin 52 extends through the borehole 50 in the frame, the slot 16 through the first side plate of the first mounting bracket, and the slot through the second side plate, of the first mounting bracket. Each slot has an upper end and a lower end. The first mounting bracket is pivotable from a first position wherein the first limit pin is positioned adjacent to the upper end of each slot to a second position wherein the first limit pin is positioned adjacent to a lower end of each slot. A second limit pin 52' extends through the borehole 56 in the frame, the slot 16' through the first side plate of the second mounting bracket, and the slot through the second side plate of the second mounting bracket. Each slot has an upper end and a lower end. The second mounting bracket is pivotable from a first position wherein the first limit pin is positioned adjacent to the upper end of each slot to a second position wherein the first limit pin is positioned adjacent to a lower end of each slot.

A first biasing means 26 is positioned between the toe of the sole and the first mounting bracket for biasing the first mounting bracket away from the heel. A second biasing means 26' is positioned between the toe of the sole and the second mounting bracket for biasing the second mounting bracket away from the toe. If desired, conventionally sized wheels 60, 60' can be mounted on the pivot pins 40, 40' to prevent the frame of the skate from dragging over rough terrain.

In accordance with another embodiment of the invention, there is provided a method for modifying a hard surface in-line skate for use on soft surfaces. In line skates suitably employed in the method comprise a frame defining transverse boreholes for carrying a first wheel, a second wheel, a third wheel, and a fourth wheel in longitudinal alignment from a back end to a front end of the frame. The wheels have a first diameter.

In accordance with the invention, the wheels are removed. A front wheel bracket is attached to the frame at the borehole for carrying the third wheel. The front wheel bracket carries a wheel suitable for use on soft surfaces and which has a diameter which is greater than the first diameter. A rear wheel bracket is attached to the frame at the borehole for carrying the second wheel. The rear wheel bracket carries a wheel suitable for use on soft surfaces and which has a diameter which is greater than the first diameter.

Preferably, the front wheel bracket is biased downwardly at a position in front of the borehole for carrying the fourth wheel. The rear wheel bracket is biased downwardly at a position behind the borehole for carrying the first wheel.

More preferably, The movement of the front wheel bracket is limited from an upper position to a lower position by a pin positioned in the borehole for the fourth wheel. The movement of the rear wheel bracket is limited from an upper position to a lower position by a pin positioned in the borehole for the first wheel.

Figure 8:
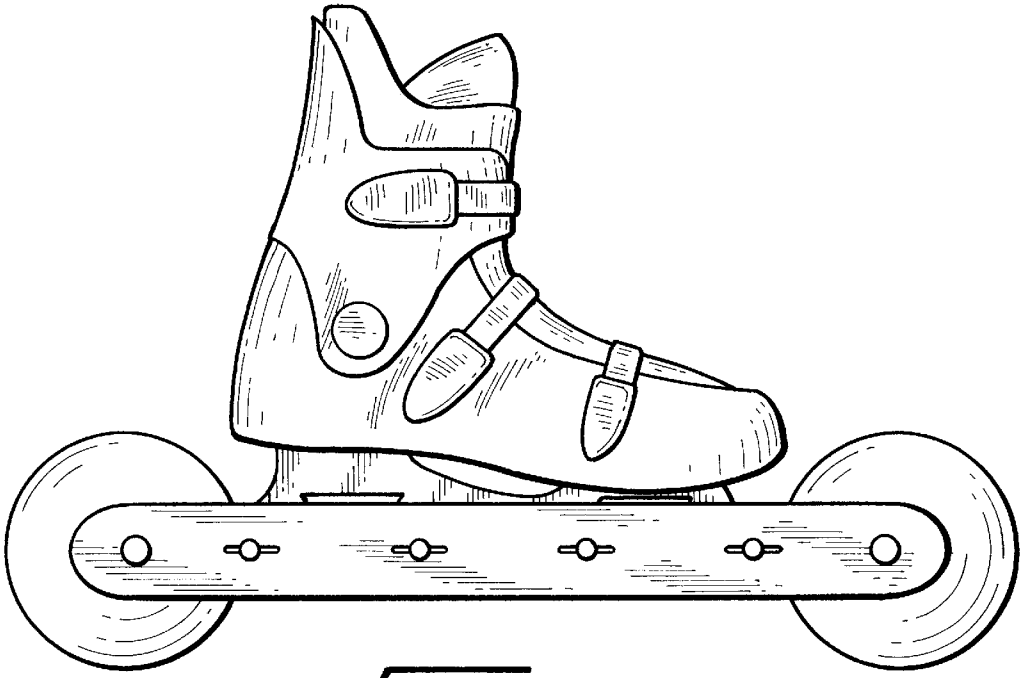
FIG. 8 is a pictorial representation of another embodiment of the invention.

Alternatively, and as shown in FIG. 8, a single mounting bracket formed from a first side plate and a second side plate can be attached to the frame. The second side plate is positioned parallel to the first side plate. The first side plate is elongated and has a first end and a second end and defines holes adjacent to the first end and the second end for carrying axle pins and holes spaced along its length for accepting mounting pins for mounting the first side plate to the boreholes through the frame of the skate. The second side plate is elongated and has a first end and a second end and defines holes adjacent to the first end and the second end for carrying axle pins and holes spaced along its length for accepting mounting pins for mounting the second side plate to the boreholes through the frame of the skate. Wheel and axle pin assemblies are preferably mounted to the holes adjacent to the ends of the plates and the plates are preferably mounted to the frames via pins passing through the boreholes in the frame and the boreholes in the plates.

While certain preferred embodiments of the invention have been described herein, the invention is not to be construed as being so limited, except to the extent that such limitations are found in the claims.

What is claimed is:

1. A mounting bracket for a wheel, said mounting bracket comprising a first side plate, a second side plate positioned parallel to the first side plate, and a spacer positioned between the first side plate and the second side plate, wherein the first side plate is elongated and has a first end and a second end, said first side plate defining a hole adjacent to the first end for carrying a pivot pin, a hole adjacent to the second end for carrying an axle pin, and an arcuate slot positioned between the first end and the second end for accepting a limit pin, said arcuate slot being radiused around the hole for carrying the pivot pin and being positioned between the hole for carrying the axle pin and the hole for carrying the pivot pin;

the second side plate is elongated and has a first end and a second end, said second side plate defining a hole adjacent to the first end for carrying a pivot pin, a hole adjacent to the second end for carrying an axle pin, and an arcuate slot positioned between the first end and the second end for accepting a limit pin, said arcuate slot being radiused around the hole for carrying the pivot pin and being positioned between the hole for carrying the axle pin and the hole for carrying the pivot pin; and the spacer fixedly connects the first side plate and the second side plate in juxtaposition so that the hole for carrying the pivot pin, the hole for carrying the axle pin, and the arcuate slot of the elongated second plate are in alignment with the hole for carrying the pivot pin, the hole for carrying the axle pin, and the arcuate slot of the elongated first plate.

2. A mounting bracket as in claim 1 wherein the first side plate has a longitudinal axis, the hole for carrying the pivot pin and the hole for carrying the axle pin are positioned along the longitudinal axis, and the second end of the first side plate is radiused around the hole for carrying the axle pin, and the second side plate has a longitudinal axis, the hole for carrying the pivot pin and the hole for carrying the axle pin are positioned along the longitudinal axis, and the second end of the second side plate is radiused around the hole for carrying the axle pin.

3. A mounting bracket as in claim 2 wherein the first side plate and the second side plate each further define a second hole adjacent to the second end for carrying an axle pin, the second hole for carrying an axle pin of the first side plate being positioned in alignment with the second hole for carrying an axle pin of the second side plate, each said second hole being positioned alongside the hole positioned along the longitudinal axis adjacent to the second end of each of said first side plate and said second side plate and being spaced apart from the longitudinal axis of the first side plate and the second side plate.

4. A mounting bracket as in claim 1 wherein each of the first side plate and the second side plate has a first face and a second face, wherein the spacer connects the second face of the first side plate to the second face of the second side plate, and wherein the holes for carrying the pivot pin, the holes for carrying the axle pin, and the arcuate slots for accepting the limit pin, are countersunk from the first face.

5. A mounting bracket as in claim 1 wherein each of the first side plate and the second side plate has a longitudinal axis and the spacer fixedly connecting the first side plate and the second side plate is positioned between the arcuate slot and the hole for carrying the axle pin.

6. A mounting bracket as in claim 5 further comprising a biasing means mounted to second face of the first side plate and the second face of the second side plate, said biasing means extending transversely from between a midportion of the first side plate and a midportion of the second side plate.

7. A mounting bracket as in claim 6 wherein the biasing means comprises a block of an elastomeric polymer.

8. A mounting bracket as in claim 7 wherein the biasing means comprises a connector plate element having a threaded bore extending transversely therethrough and the biasing means comprises a screw extending from the block of elastomeric polymer and received by the threaded bore through the connector plate element.

9. A mounting bracket as in claim 8 wherein the threaded bore is defined by a tubular insert which is press fitted into a borehole extending through the connector plate element.

10. A mounting bracket as in claim 9 wherein the connector plate element has a first end positioned adjacent to the second face of the first plate and a second end position adjacent to the second face of the second plate and a longitudinal axis extending between the first end and the second end, wherein said connector plate element is mounted to the first plate and the second plate for rotation around its longitudinal axis.

11. A mounting bracket as in claim 6 further comprising, in combination an axle pin carried by the holes adjacent to the second end of the first side plate and the second side plate, and a wheel rotatably mounted to the axle pin.

12. A mounting bracket as in claim 6 further comprising, in combination a boot formed from an upper body and a sole, said sole having a heel and a toe, and a frame attached to the sole of the boot and extending away from the upper body, said frame having a borehole extending transversely therethrough and a front end positioned beneath the toe of the sole, a pivot pin extending through the borehole in the frame, the hole adjacent to the first end of the first side plate, and the hole adjacent to the first end of the second side plate, said pivot pin pivotally connecting the mounting bracket to the frame;

wherein the biasing means is positioned against the toe of the sole to bias the mounting bracket away from the toe of the sole.

13. A combination as in claim 12 further comprising an axle pin carried by the holes adjacent to the second end of the first side plate and the second side plate, and a wheel rotatably mounted to the axle pin.

14. A combination as in claim 13 wherein the frame further has a second borehole extending transversely therethrough, wherein said combination further comprises a limit pin extending through the second borehole in the frame, the slot through the first side plate, and the slot through the second side plate, wherein each slot has an upper end and a lower end, the bracket is pivotable from a first position wherein the limit pin is positioned adjacent to the upper end of each slot to a second position wherein the limit pin is positioned adjacent to a lower end of each slot, and the bracket is biased toward the first position by the biasing means.

15. A mounting bracket as in claim 6 further comprising, in combination a boot formed from an upper body and a sole, said sole having a heel and a toe, and a frame attached to the sole of the boot and extending away from the upper body, said frame having a borehole extending transversely therethrough and a back end positioned beneath the heel of the sole, a pivot pin extending through the borehole in the frame, the hole adjacent to the first end of the first side plate, and the hole adjacent to the first end of the second side plate, said pivot pin pivotally connecting the mounting bracket to the frame;

wherein the biasing means is positioned against the heel of the sole to bias the mounting bracket away from the heel of the sole.

16. A combination as in claim 15 further comprising an axle pin carried by the holes adjacent to the second end of the first side plate and the second side plate, and a wheel rotatably mounted to the axle pin.

17. An in line skate comprising a boot formed from an upper body and a sole, said sole having a heel and a toe, a frame attached to the sole of the boot and extending away from the upper body, said frame having a back end positioned beneath the heel and a front end positioned beneath the toe and defining a first transverse borehole positioned beneath the heel, a second transverse borehole beneath the toe, a third transverse borehole between the first transverse borehole and the second transverse borehole, and a fourth transverse borehole between the third transverse borehole and the second transverse borehole;

a first mounting bracket and a second mounting bracket attached to the frame, each mounting bracket comprising a first side plate and a second side plate positioned parallel to the first side plate, wherein the first side plate is elongated and has a first end and a second end, and defines a hole adjacent to the first end for carrying a pivot pin and a hole adjacent to the second end for carrying an axle pin, wherein the second side plate is elongated and has a first end and a second end and defines a hole adjacent to the first end for carrying a pivot pin and a hole adjacent to the second end for carrying an axle pin, wherein each side plate of the first mounting bracket defines an arcuate slot positioned between the first end and the second end for accepting a limit pin, said arcuate slot being radiused around the hole for carrying the pivot pin, wherein each side plate of the second mounting bracket defines an arcuate slot positioned between the first end and the second end for accepting a limit pin, said arcuate slot being radiused around the hole for carrying the pivot pin, a first pivot pin extending through the third borehole in the frame, the hole adjacent to the first end of the first side plate of the first mounting bracket, and the hole adjacent to the first end of the second side plate of the first mounting bracket, said first pivot pin pivotally connecting the first mounting bracket to the frame beneath the toe of the sole;

wherein the first side plate and the second side plate of the first mounting bracket are mounted to the frame in juxtaposition with each other so that the hole for carrying the pivot pin and the hole for carrying the axle pin of the first side plate are in alignment with the hole for carrying the pivot pin and the hole for carrying the axle pin of the second side plate, a second pivot pin extending through the fourth borehole in the frame, the hole adjacent to the first end of the first side plate of the second mounting bracket, and the hole adjacent to the first end of the second side plate of the second mounting bracket, said second pivot pin pivotally connecting the second mounting bracket to the frame beneath the heel of the sole;

a first axle pin carried by the holes adjacent to the second end of the first side plate and the second end of the second plate of the first mounting bracket;

a first wheel rotatably mounted to the first axle pin;

second axle pin carried by the holes adjacent to the second end of the first side plate and the second end of the second plate of the second mounting bracket;

a second wheel rotatably mounted to the second axle pin;

a first limit pin extending through the second borehole in the frame, the slot through the first side plate, and the slot through the second side plate, of the first mounting bracket;

wherein each slot has an upper end and a lower end, the first mounting bracket is pivotable from a first position wherein the first limit pin is positioned adjacent to the upper end of each slot to a second position wherein the first limit pin is positioned adjacent to a lower end of each slot, and a second limit pin extending through the first borehole in the frame, the slot through the first side plate, and the slot through the second side plate, of the second mounting bracket:

wherein each slot has an upper end and a lower end, and the second mounting bracket is pivotable from a first position wherein the first limit pin is positioned adjacent to the upper end of each slot to a second position wherein the first limit pin is positioned adjacent to a lower end of each slot.

18. An in-line skate as in claim 17 further comprising a first biasing means positioned between the toe of the sole and the first mounting bracket for biasing the first mounting bracket away from the toe, and a second biasing means positioned between the toe of the heel and the second mounting bracket for biasing the second mounting bracket away from the heel.

19. A method for modifying an in-line skate suited for use on hard surfaces so that it is suited for use on soft surfaces, said in line skate comprising a first defining transverse boreholes for carrying, on axle pins mounted in the transverse boreholes, a first wheel, a second wheel, a third wheel, and a fourth wheel in longitudinal alignment from a back end to a front end of the frame, said wheels having a first diameter, said method comprising removing the wheels and axle pins, attaching a wheel bracket which carries a pair of all terrain wheels to the frame by means of mounting pins mounted through at least some of the reverse boreholes;

wherein said wheel bracket comprises a single mounting bracket formed from a pair of longitudinally elongated parallel side plates, positioned one on each side of the frame, each plate having a first end and a second end, holes spaced along its length for accepting the mounting pins which mount it to the frame, and holes adjacent to its first end and its second end for accepting axle pins which mount the pair of all terrain wheels to the bracket, wherein said wheel bracket carries a pair of all terrain wheels on the axle pins which are suitable for use on soft surfaces and have a diameter which is greater than the first diameter.

20. A method as in claim 19 wherein the holes spaced along the length of the longitudinally elongated parallel side plates are longitudinally extending slots.

* * * * *